US005452774A

United States Patent [19]

Davis et al.

[11] Patent Number: 5,452,774

[45] Date of Patent: Sep. 26, 1995

[54] ENDLESS ROLLER CHAIN DRIVE WITH INTERLOCKING TRACTION RAIL

[76] Inventors: Link H. Davis, P.O. Box 366, Hurst, Tex. 76053; Henry J. McGinnis, 7241 Martha La., Fort Worth, Tex. 76112

[21] Appl. No.: 140,847

[22] Filed: Oct. 25, 1993

[51] Int. Cl.[6] ..... B66B 11/04

[52] U.S. Cl. ..... 187/270; 187/900; 254/95

[58] Field of Search ..... 187/19, 6, 1 R, 187/270, 900; 254/95, 97; 182/142

[56] References Cited

U.S. PATENT DOCUMENTS

| | | | |
|---|---|---|---|
| 904,717 | 11/1908 | Palmer | 187/19 |
| 4,467,889 | 8/1984 | Maubach et al. | 187/19 |
| 4,516,663 | 5/1985 | D'Alessio et al. | 187/19 |

FOREIGN PATENT DOCUMENTS

| | | | |
|---|---|---|---|
| 8868 | of 1900 | United Kingdom | 187/19 |

*Primary Examiner*—Kenneth Noland

[57] ABSTRACT

A mechanical drive assembly composed of an endless roller chain (78) and notched rail (100) wherein multiple chain rollers (79) engage corresponding rail notches (103 ) to securely interlock drive (38) and rail (100). Drive (38) is equipped with a triple-strand roller chain (78) whose center strand of rollers engage notched bar (102) while outer strand rollers roll across face of pressure plate (50). Drive assembly (38) may be held in a fixed position relative to a static rail (100) by applying a braking force to drive sprocket (76), or it may be moved tangentially to rail (100) by applying torque to drive sprocket (76). Conversely, rail (100) and any structure attached thereto may be held in a fixed position or moved tangentially relative to a statically mounted drive (38) by similar means.

19 Claims, 9 Drawing Sheets

ENDLESS ROLLER CHAIN DRIVE WITH INTERLOCKING TRACTION RAIL

BACKGROUND—FIELD OF INVENTION

Figure 1:
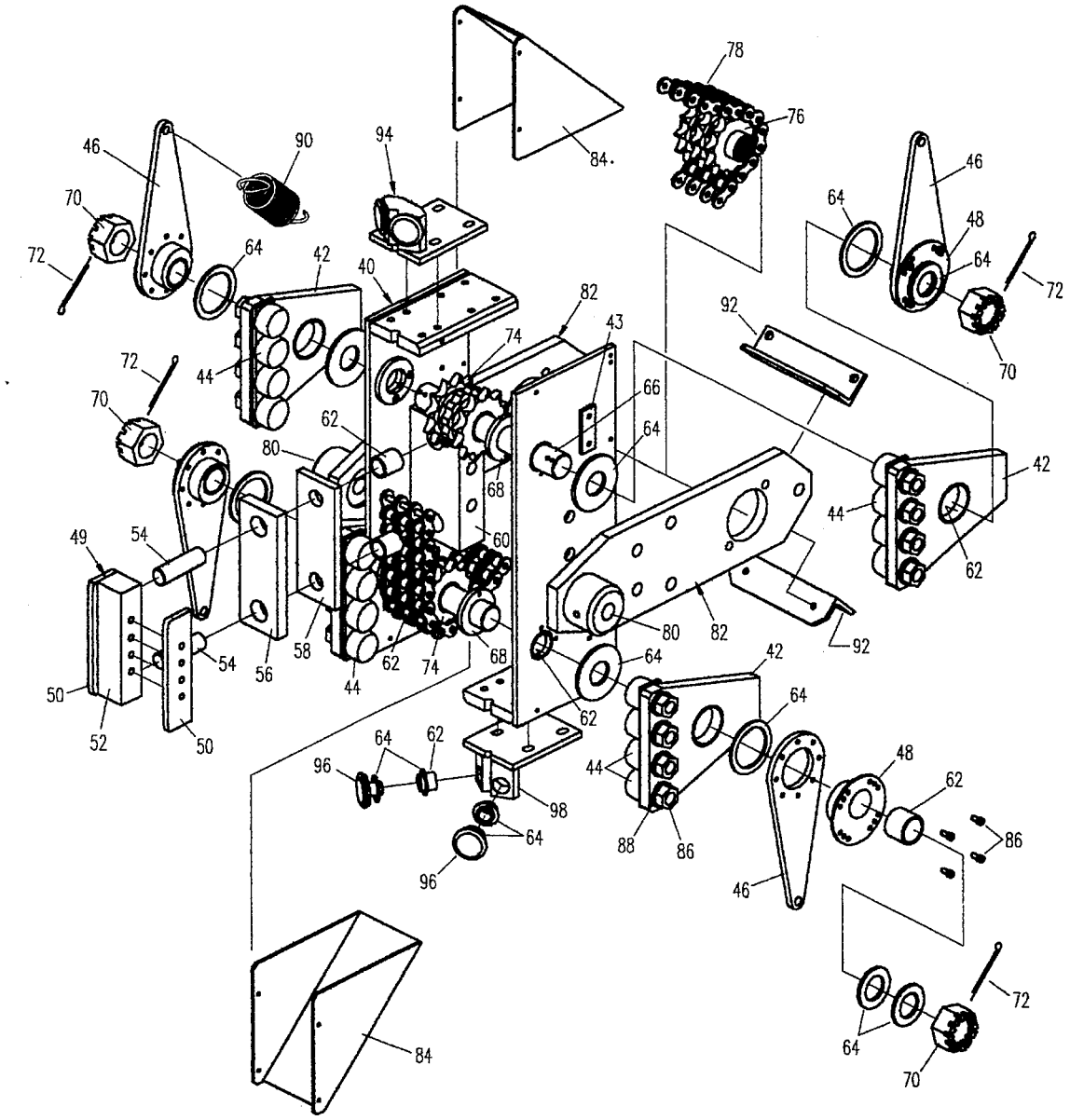

Our invention relates to elevators, amusement rides, cranes, and erection systems, begetting heretofore unheard-of opportunities for the advancement of mechanically interlocked structures and drives for the purpose of translating and/or elevating passengers, payloads, structural components, or entire structures in and of themselves.

BACKGROUND—ELEVATOR TECHNOLOGY

Cable drawn elevator systems rely upon single or multiple strands of wire rope to transport their passengers and/or payload. These systems offer a smooth, quiet ride. But the cables are subject to wind vibration, elongation, rust, wear and breakage. These cables are exceedingly difficult to inspect. Particularly on large towers, which can rise 2000' feet or more above the ground, harm to the cable is likely to occur somewhere along its path up the structure . . . Such damage is almost impossible to detect before it is too late. Furthermore, winches required to operate these systems are expensive, and cables are very costly and dangerous to replace.

Rack and pinion elevator systems rely upon a spur gear and matching gear rack to transport their passengers and/or payload. This arrangement offers positive engagement of the drive mechanism directly to the structure it is climbing, eliminating both the dangerous cables and costly winches. However, the spur gear engages only one gear tooth at a time, and constant cyclical loading tends to berrell-harden the teeth causing fatigue cracks. So the system cannot operate if a single tooth is broken or chipped, or if a minor obstruction is caught on or in between the teeth. Finally, gear rack is excessively heavy and expensive.

Cable drawn and rack and pinion systems have difficulty negotiating curves. This limits the creativity of designers, forcing them to use straight or gently curving elevator paths when ones which arc and twist might be more appealing in special industrial applications and/or architectural, decorative, or amusement park settings.

Cranes are the most popular and versatile type of equipment for erecting tower, bridge, space frame, beam, column, and other structures or structural components. But on large projects and remote construction sites, cranes tall and mobile enough to do the job are simply not available. In these instances contractors must resort to the use of helicopters and/or rigging. Both of these techniques are costly, not to mention dreadfully dangerous to everyone on or near the site.

A number of innovative emergency or quick-erect antenna masts are available using several different technologies. Some rely on a small crane to set a lightweight structure. Others use a pivoting base to allow a partial tower to be towed up into its vertical stance, secured by guy wires, and then completed using standard rigging techniques. Still others use telescoping tubes or ejected ribbons. To this day there is no self-contained system capable of erecting a rigid structure of substantial height and strength.

Enterprising engineers have devised new methods for erecting concrete and composite structures, while lattice tower and truss erection has remained basically unchanged. The current methods rely either on cranes or dangerous assembly by hand while climbing or dangling. Often workers are suspended precariously from great heights as they go about their task of assembling, bolting, and/or welding steel piece by piece. Worker productivity is reduced because the labor cannot be performed conveniently. Besides the obvious hazards, these methods additionally limit the creativity of designers because the current assembly options are so narrow and painfully restricted.

OBJECTS AND ADVANTAGES

Several objects and advantages of our invention are: (A) inexpensive and lightweight rail construction, (B) fault-tolerant multi-tooth/roller drive engagement, (C) smooth and quiet operation, (D) ease and safety of inspection, operation, maintenance, and repair, (E) versatile rail and drive construction for creative designs, (F) tremendous lifting capacity and high factors of safety, (G) efficient operation at variable operating speeds, (H) economical drive built from common mechanical and simple machined components.

(A) In contrast to cable-driven elevators, our system mechanically interlocks with a secure rail attached directly and incrementally to the support structure. No single splice or connection failure can threaten the safety of our system. Our drive rail may be composed of simple punched and notched structural shapes and bars. No close tolerance machining is required. Unlike rack-and-pinion rails which are very wide and heavy, our rack-and-chain rails are thin and efficient because the static and dynamic loads are distributed among several chain rollers and rail notches rather than a single gear tooth.

(B) Our invention engages chain rollers in multiple rail notches simultaneously. Unlike rack and pinion systems, our drive does not depend upon any single gear tooth. Faulty fabrication, accidental damage, or material failure of any given notch or group of notches will not adversely affect normal and safe operation of our system. Rather than high strength, flame-hardened gears and racks, as used in rack and pinion systems, mild A36 steel can be employed in our rail, and forged rollers used in our drive chain. This arrangement reduces the chances of cracking due to metal fatigue, and allows the harder chain rollers to smooth out small tolerance errors in the softer rail. In sharp contrast to rack-and-pinion systems which rely upon expensive, close tolerance machine work,fabrication of our rail can utilize simple manual labor and reasonable tolerances. So in addition to being safer and more reliable, cost savings on tall structures using our rail can amount to tens and even hundreds of thousands of dollars.

(C) By virtue of a gentle engagement/disengagement path, our invention is extremely quiet during operation. In contrast to rack-and-pinion systems used outdoors, whose gear teeth must literally scrape against one another during movement (lubrication would only attract dust and dirt), contact surfaces in our system are entirely rolling. Chain rollers which contact the drive rail notches are free to turn And chain rollers passing across the backing plate are also free to turn.

(D) Our invention is very easy to inspect because of its simplicity. In a cable-drawn system one cannot see all of the parts relevant to safe operation neatly situated in one location. And rack-and-pinion systems rely on the integrity of very fine tooth detail which is impossible to discern without a very close look and use of special x-ray and/or ultrasonic equipment. The notches in our rail, depending upon the magnitude of load to be lifted and required factors of safety, are about one inch apart. This amounts to far less detail to visually inspect when compared to a rack-and-pinion, and an operator can easily see the rail in sufficient detail from within his lift basket or other assembly by driving up or down at slow speed. Also, all of the machinery for our drive can fit within a compact space approximately 2'×2'×2'. Before operating the system the average individual given minimal instruction can check the integrity of the drive chain and associated bolts, nuts, sprockets, rollers, and other basic components. Our invention is similar in design to that of a tractor in that it is built to be easy to see, reach, lubricate, and replace major pans.

(E) Our invention is far easier to install on a straight travel path than either a cable drawn or rack-and-pinion system due to our rail's simplicity and lightness, and our system's ability to assist in its own erection. But of greater significance is its potential for use in creative designs. With our system an elevator can easily be made to climb up the inside of an arch (and back down the other side if so desired). We can literally wrap it around a square building, traveling at diagonals on the faces and then around sloped and twisted curves at the corners. Even easier and more graceful, we can spiral our drive around circular or elliptical structures, offering riders a spectacular sight seeing experience. And to top it all off, these and other exciting applications can be explored at lesser expense than conventional straight-run systems.

(F) Because multiple notches are engaged simultaneously, the lift capacity and factors of safety our invention is capable of are extremely high. Multiple drives can be used in tandem, putting twenty, fifty, one hundred or more rail notches to work at the same time. A typical application might distribute 4,000 lbs across 20 notches for an average load of only 200 lbs per notch. So if the chain roller contact area on the notches averaged ¼"×¼", and the rail material was A36, the actual capacity per notch would be approximately 2,250 lbs, thus the factor of safety would be 2,250/200 or 11.25:1. Assuming two 80-3 roller chains were used in this tandem drive application, with a rated working load of over 45,000 lbs each, the chain safety factor would be 90,000/4000 or 22.5:1.

(G) Our invention operates well at variable speeds. Unlike cable drawn and rack-and-pinion systems which typically have simple UP/DOWN/STOP controls, our systems are readily equipped with variable speed hydrostatic or electric drives. The efficiency of the chain drive and rolling friction surfaces makes our invention ideal for applications where sensitive variable speed is required.

(H) Although our invention requires many custom-machined parts, they are basic and simple to fabricate. Roller chain, sprockets, bushings, bearings, bolts, and springs are readily available from any number of sources around the world, making our system extremely easy to build and maintain anywhere on the globe. This feature makes our invention very valuable because it provides superior operating safety and versatility at a minimum cost of time, money, and expertise.

DRAWING FIGURES

FIG. 1 Exploded view of endless roller chain drive assembly 38

Figure 2:
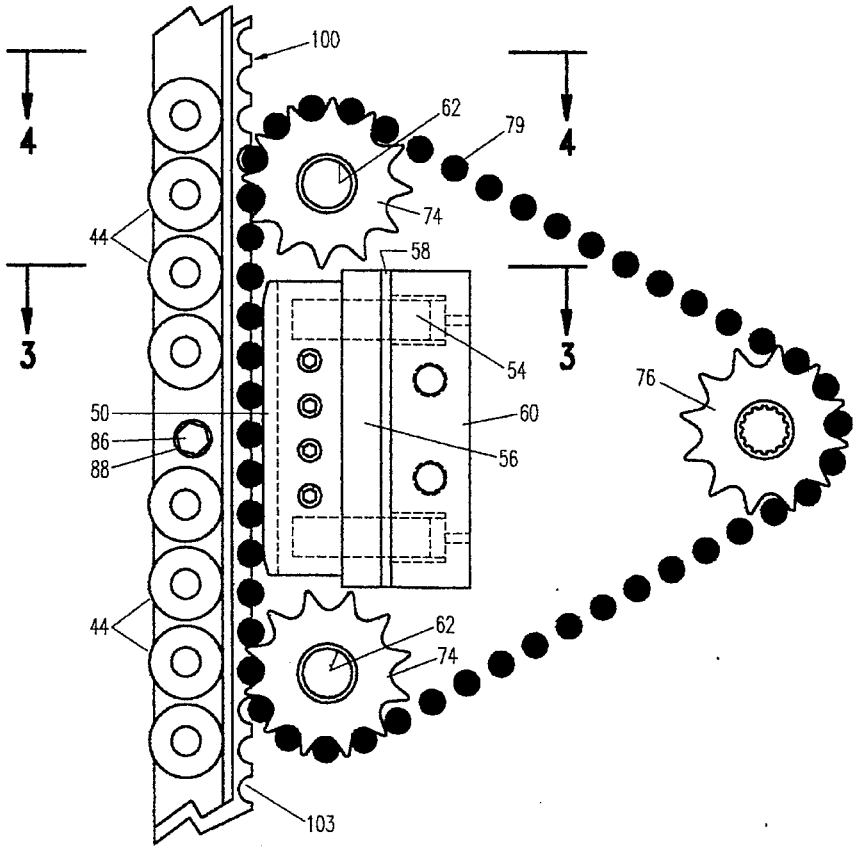

FIG. 2 Sectional view of drive 38 and rail 100

Figure 3:
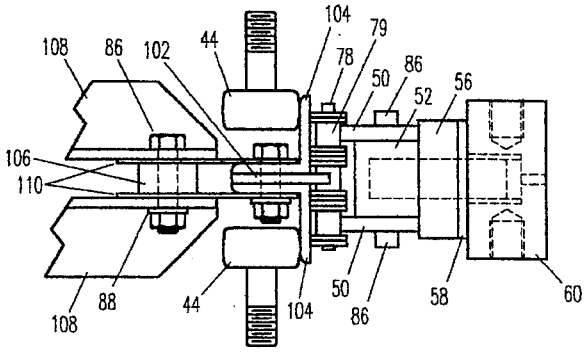

FIG. 3 Sectional view taken from FIG. 2 of drive 38 and rail 100

Figure 4:
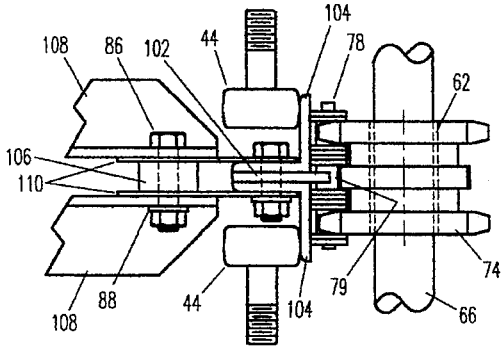

FIG. 4 Sectional view taken from FIG. 2 of drive 38 and rail 100

Figure 5:
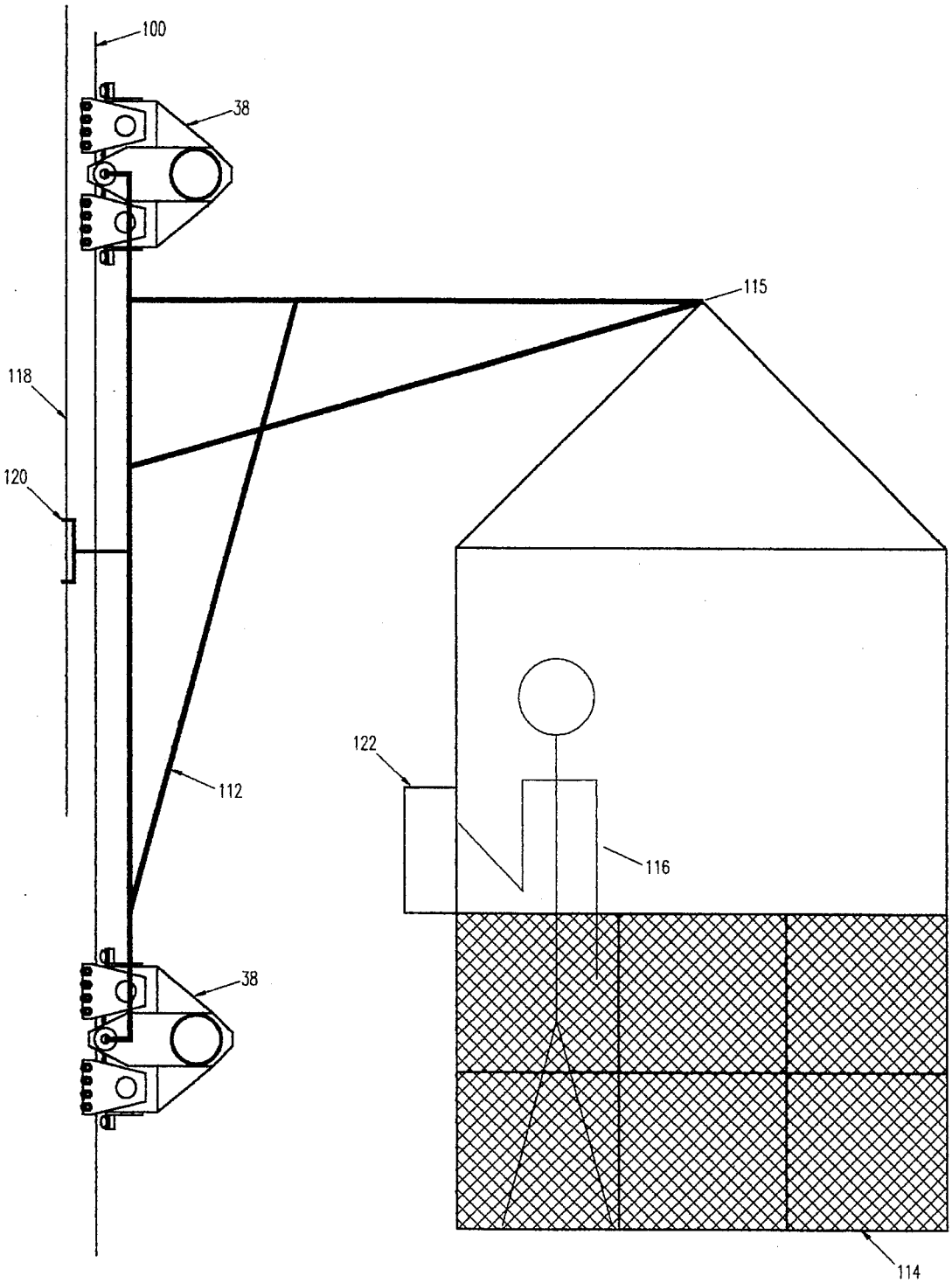

FIG. 5 Side view of amusement ride lift for arches

Figure 6:
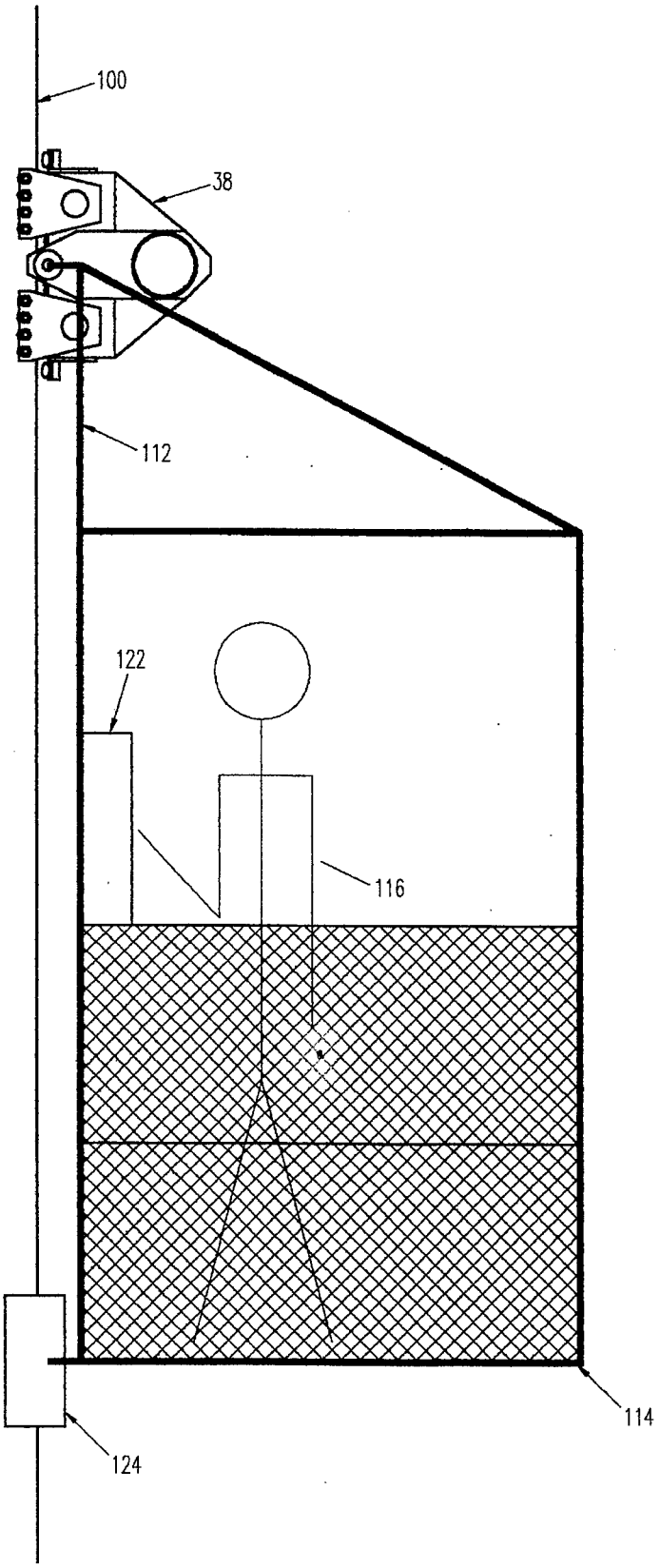

FIG. 6 Side view of personnel/payload lift for tower and elevator shafts

Figure 7:
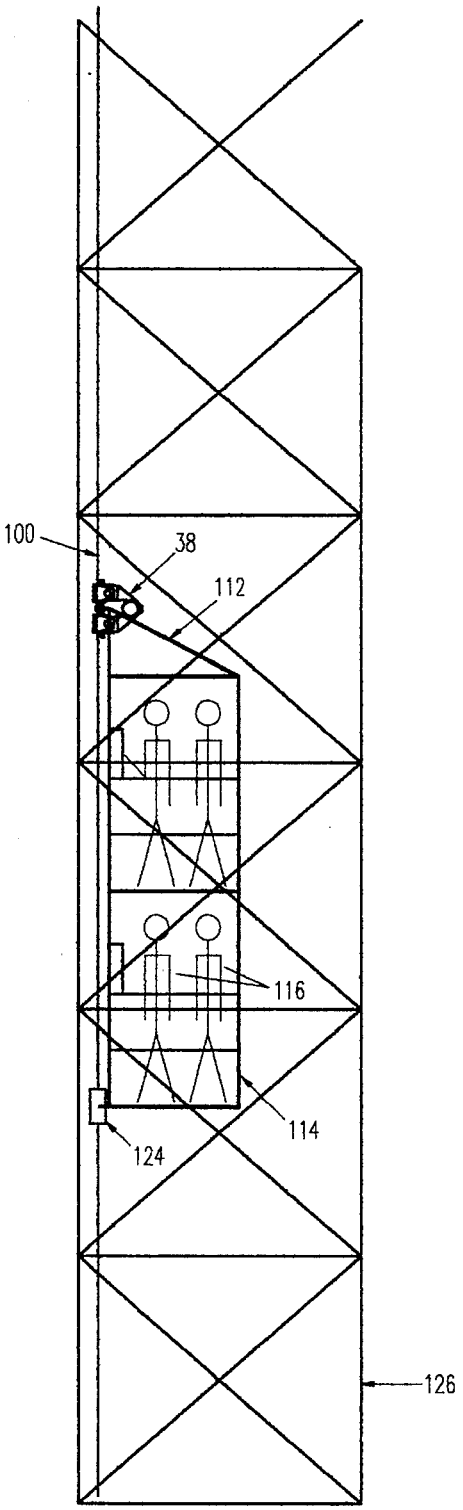
Figure 8:
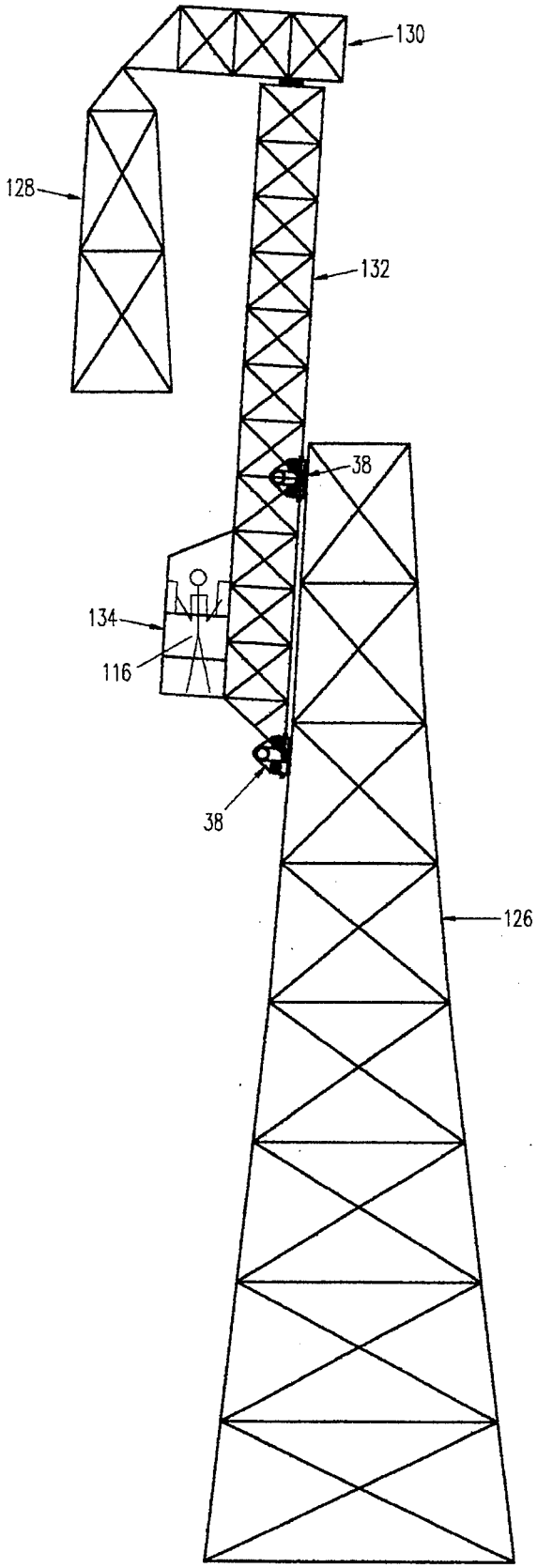

FIG. 7 Side view of multi-level personnel/payload lift for tower and elevator shafts FIG. 8 Side view of articulated boom 132 used to erect tower structure 126

Figure 9:
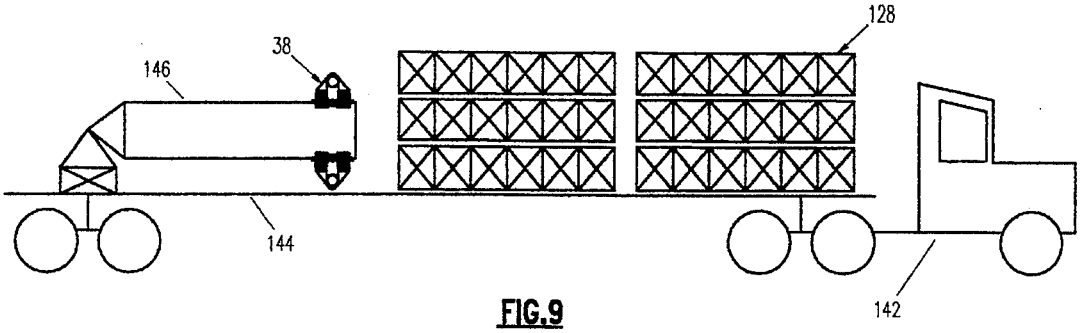

FIG. 9 Side view of portable tower erection system stowed for transport

Figure 10:
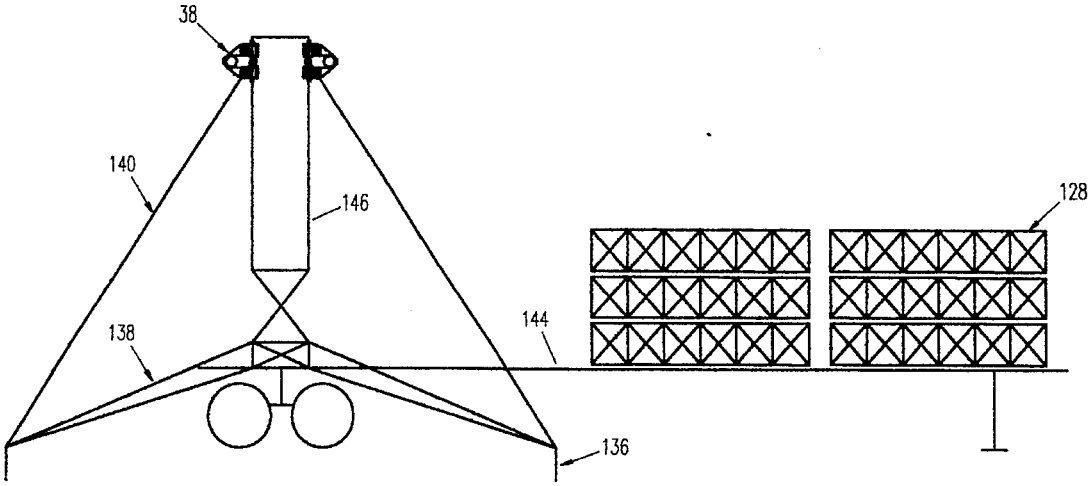
Figure 11:
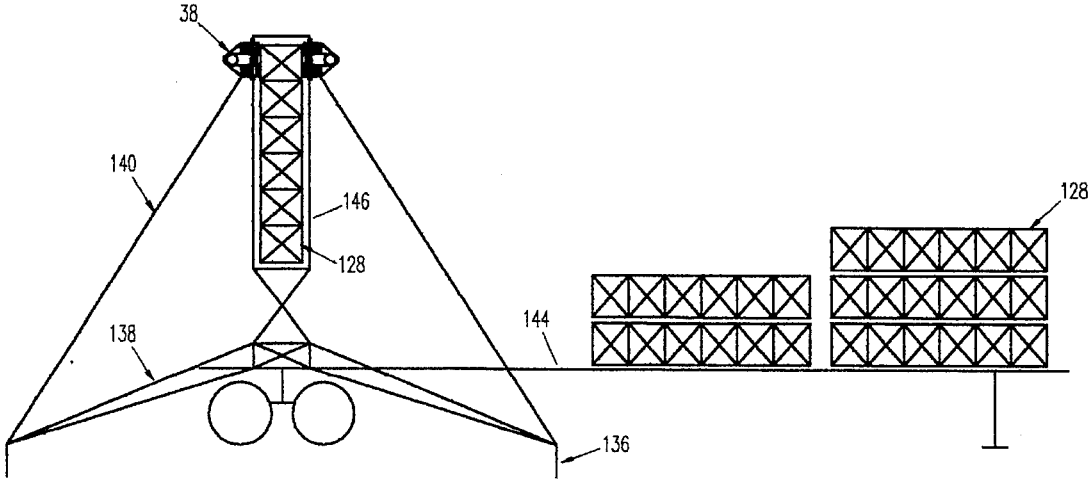

FIG. 10 Side view of portable tower erection system made ready for erection of tower FIG. 11 Side view of portable tower erection system loaded with first structural sub-assembly 128

Figure 12:
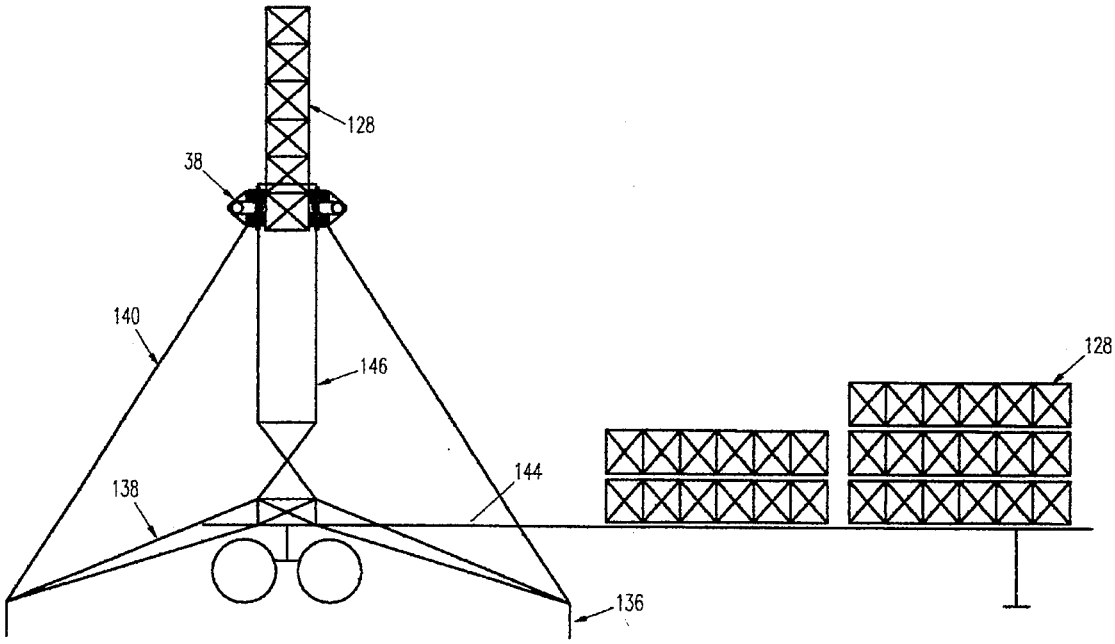
Figure 13:
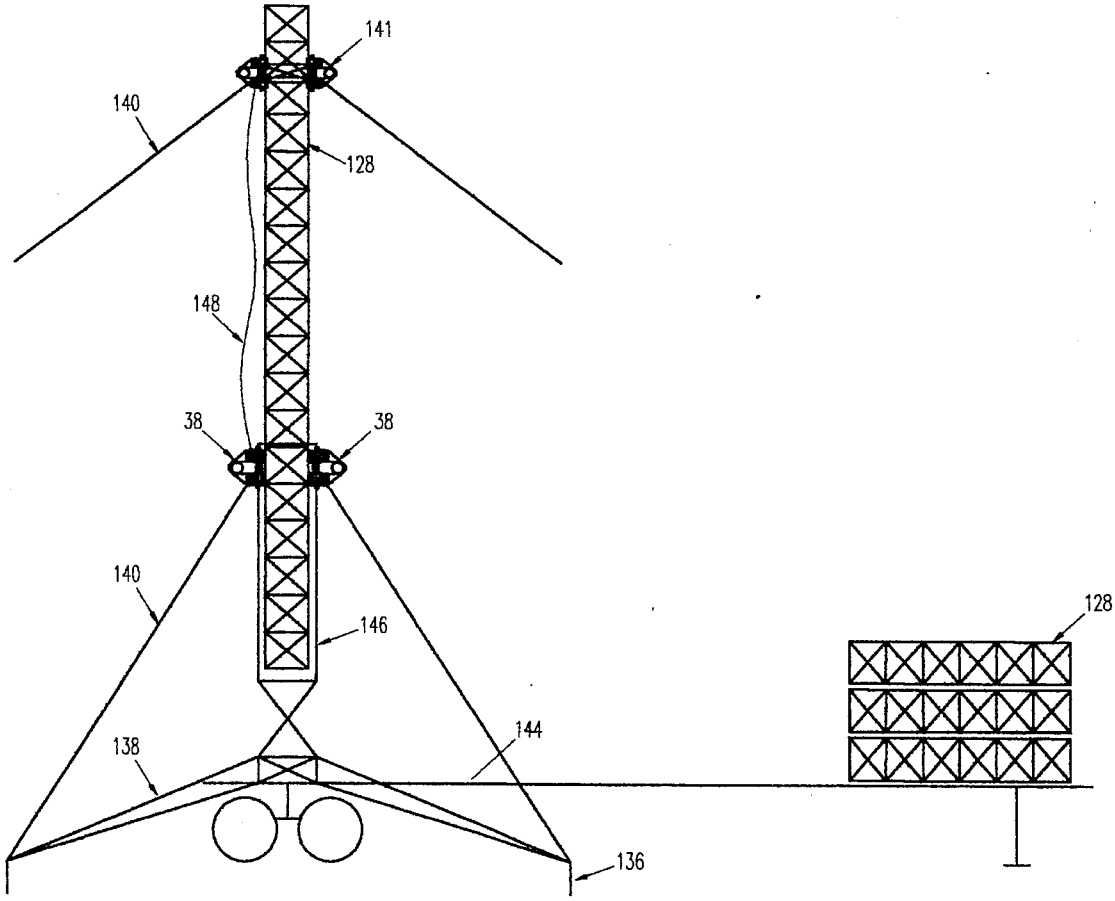

FIG. 12 Side view of portable tower erection system with first sub-assembly 128 extruded FIG. 13 Side view of portable tower erection system with additional sub-assemblies 128 extruded. Stabilizing guy wire drive assembly 141 is interlocked with extrusion assembly 146 to maintain its constant vertical position and therefore constant tension of guy wire assembly 140 as progressive sub-assemblies 128 are continually extruded to form a complete tower.

Figure 14:
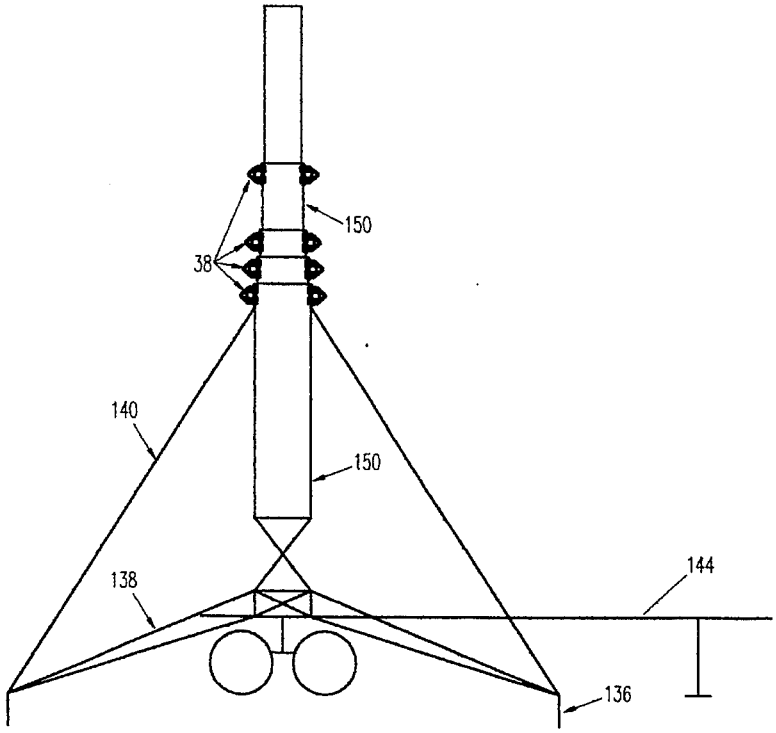

FIG. 14 Side view of portable telescoping mast 150

Figure 15:
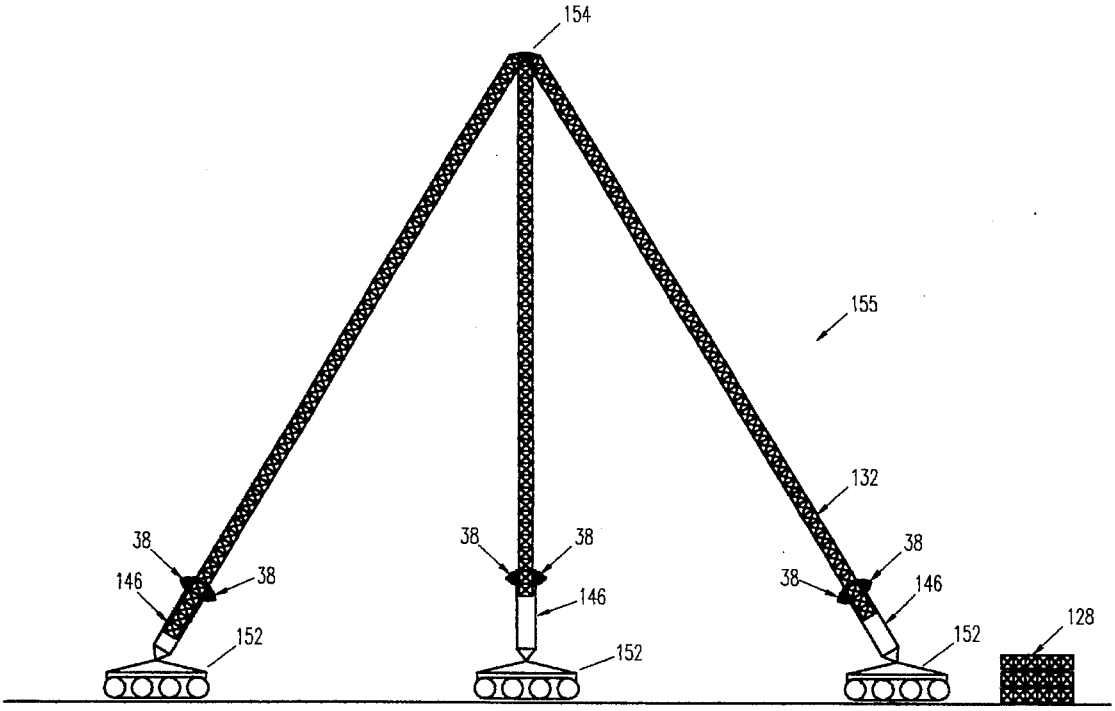

FIG. 15 Side view of articulated tripod boom assembly 155 equipped with articulated mobile extrusion bases 152 and tress 132 subassemblies 128

Figure 16:
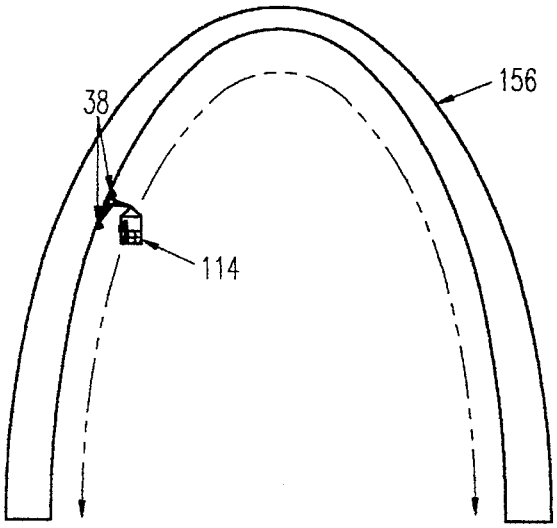

FIG. 16 Elevation view of arch 156 equipped with amusement ride lift (FIG. 5)

Figure 17:
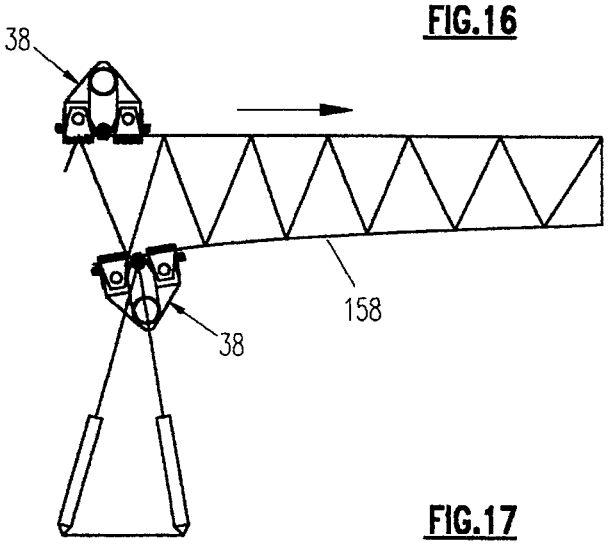
Figure 18:
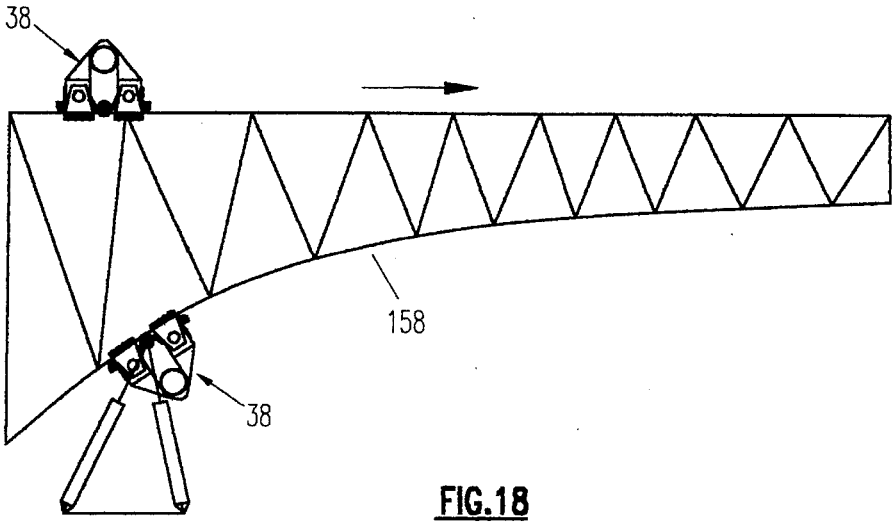

FIG. 17 Elevation view of variable geometry structure 158 being extruded horizontally FIG. 18 Elevation view of variable geometry structure 158 being extruded horizontally as endless roller chain drive assemblies 38 adjust to varying pitch and roll of drive rails connected directly to structure 158

LIST OF REFERENCE NUMERALS

38 Endless roller chain drive assembly
40 Drive housing, welded assembly
42 Roller plate, track tolerance adapting
43 Roller plate flat bushing
44 Cam roller, track tolerance adapting
46 Eccentric, lever arm, track tolerance adapting
48 Eccentric, offset center block, track tolerance adapting
49 Pressure plate assembly
50 Pressure plate, chain roller contacting
52 Pressure plate, movable holding block
54 Pressure plate, guide pins
56 Pressure plate, shock absorbing rubber block
58 Pressure plate, engagement adjustment shim plate
60 Pressure plate, slider block
62 Bushing, oil impregnated bronze, typical
64 Washer, oil impregnated bronze, typical
66 Shaft, stationary
68 Shaft registration ring

70 Castle nut
72 Cotter pin
74 Sprocket
76 Drive/brake sprocket
78 Triple strand roller chain
80 Pivot point, drive attachment hitch
82 Motor/brake attachment frame, welded assembly
84 Chain cover
86 Threaded fastener, typical
88 Lock washer, typical
90 Spring, rail tolerance adapting
92 Spring attachment bracket
94 Centering guide roller assembly
96 Centering guide roller
98 Centering guide roller block
100 Drive rail assembly
102 Notched chain engagement bar
103 Semicircle notch
104 Smooth cam roller rail L-shape
106 Ring fill, spacer washer, or block
108 Structural rail attachment bracket
110 Structural rail attachment plate
112 Carriage assembly
114 Lift basket
115 Lift basket pivot point
116 Person
118 Electrical inductance bar assembly
120 Electrical collector assembly attached to carriage 112
122 Motor/brake control box
124 Guide wheel assembly
126 Tower structure or elevator shaft
128 Structural component or sub assembly
130 Articulated boom
132 Truss assembly
134 Operator cabin assembly
136 Ground anchor assembly
138 Outrigger assembly
140 Guy wire assembly
141 Stabilizing guy wire drive assembly
142 Track
144 Trailer
146 Extrusion assembly
148 Guy level drive synchronization control cable
150 Telescoping tower mast
152 Articulated mobile extrusion base
154 Articulated boom pivot joint
155 Articulated tripod boom assembly
156 Arch
158 Variable geometry structure

Description of Our Invention

A typical embodiment of our invention is illustrated in FIG. 1 (exploded view) and FIGS. 2, 3, & 4 (conceptual views). The drive has a mechanical housing 40 composed of two side plates and two end plates welded together and forming a single component. The side plates are symmetrically machined to accept mounting of bushings 62, shafts 66, shaft registration rings 68, pressure plate slider block 60, motor/brake attachment frames 82, roller plate flat bushings 43, and chain covers 84. The end plates are also symmetrically machined and made to accept the mounting of centering guide roller assemblies 94.

The side plates are composed of 8"×22"×⅜" 6061-T6 aluminum And the end plates are composed of 4"×8"×⅜" 6061-T6. Oil impregnated bronze bushings 62 are press fit into side plates. Inch and a half diameter 4140 ground and polished steel shafts 66 mate with bushings in side plates with a close tolerance of +0.003/−0.000. The 6061-T6 shaft registration rings 68 are mounted to the inside face of side plates with countersunk head socket screws and do not interfere with shafts 66. The 6061-T6 motor/brake attachment frames 82 and 6061-T6 pressure plate slider block 60 share common ¾"304 stainless steel bolts. These bolts pass consecutively through 82 and 40 before fastening into machined threads of 60. Bronze roller plate flat bushings 43 attach to housing 40 via stainless steel countersunk head socket screws. And chain covers 84 attach to housing 40 with stainless steel socket head cap screws.

Standard twelve tooth triple chain sprockets 74 arc faced off to fit within drive housing 40, and the center row of teeth milled down to prevent interference with rail 100 (FIG. 4). Bushings 62 are press-fit into sprockets 74 and mate to shafts 66 with a running tolerance. Oil impregnated bronze washers 64 supply a smooth surface between registration rings 68 and sprockets 74. A standard twelve-tooth triple chain sprocket 76 equipped with a keyed or splined bore or billet is mounted and sandwiched in-between drive motor and brake. Spacing of the sprockets provides clearance of pressure plate assembly (FIG. 2), satisfies minimum drive sprocket engagement angle, and requires 52 pitches of 80-3 standard triple strand roller chain.

Set screws threaded through registration rings 68 mate with holes in shafts 66, preventing shafts 66 from turning. Sprockets 74 supplied with bushings 62 turn about stationary shafts 66. Flame-hardened 4140 steel pressure plates 50 are mounted to 6061-T6 movable holding block 52 via stainless steel socket head cap screws. One inch diameter 4140 ground and polished steel pins 54 are press-fit into parallel holes in block 52. Pressure plate slider block 60 has oil impregnated bronze bushings 62 press-fit into holes which are collinear with pins 54 mounted in block 52. Fifty durometer neoprene rubber 3"×8"×¾" shock-absorbing block 56 and A36 steel 3"×8"×¼" engagement adjustment shim plate 58 slip over mounted pins 54 with a loose fit. Pressure plate assembly 49 then mounts into slider block 60 engaging bushings 62 with a running tolerance fit. Pressure plates 50 have a 1"long by 15 degree bevel with ¼" radii (FIG. 2) on each end which contacts forged chain rollers 79 (FIG. 3). Shock-absorbing pad 56 (FIG. 2) pushes chain 78 against rail assembly 100, forcing multiple rollers to engage with notched chain engagement bar 102 and links of chain 78 to lay against cam roller rail L-shapes 104.

Three-quarter inch diameter stud by 1–⅞" diameter steel crowned cam rollers 44 travel along rails 104 opposite chain 78 (FIG. 2, 3, & 4). Cam rollers 44 mount to 4140 ¾" thick steel track tolerancing roller plate 42, secured by lock washer 88 and nut 86. Bushings 62 are press-fit into roller plates 42 and machined for a running fit around neck of 6061-T6 offset center blocks 48. Washers 64 of equal thickness to flat bushings 43 are mounted around shafts 66 and roller plates 42 are mounted flush against each. Then washers 64, lever arms 46, and offset center blocks 48 (equipped with bushings 62 with a running tolerance fit for shafts 66) are mounted around shafts 66. Necks of offset center blocks 48 mate inside of roller plates 42 and are free to turn about stationary shafts 66.

Stainless steel socket head cap screws 86 secure lever arms 46 to offset center blocks 48. Washers 64 are placed over shafts 66 against offset center blocks 48. Castle nuts 70 attach to shafts 66, securing roller plates 42 and offset center block 48 assemblies firmly against drive housing 40. Cotter pins 72 pass through holes in shafts 66 and mate with notches in castle nuts 70. Galvanized rail tolerancing springs 90 attach to lever arms 46 and brackets 92. Brackets 92 bolt to motor/brake mounting frames 82. 6061-T6 pivot point drive hitches 80 are threaded for a 1"stainless steel bolt and situated within the same plane as center of chain 78 with respect to its line of action across face of pressure plate assembly 49 and equidistant between sprockets 74.

The 6061-T6 centering guide roller blocks 98 have press-fit bronze bushings 62 which mate with 4140 flame-hardened steel centering rollers 96. Washers 64 act as bearings between roller blocks 98 and centering rollers 96. Face and side edges of centering rollers 96 contact cam roller rails 104 and notched chain engagement bar 102 on both sides of centerline of track 100.

The smooth cam roller rail L-shapes 104 are constructed of A36 2"×2"×¼" L-shapes and punched every 12" with bolt holes (FIG. 2). The notched chain engagement bar 102 is made of A36 2 ½"×¼" bar punched with bolt holes to match cam roller rails 104 and 11/16" diameter semicircles on 1" centers 103 to match the ⅝" rollers 79 and one inch pitch of chain 78. A consistent dimensional tolerance of +/−1/16" is held fabrication of 11 holes and semicircles.

Operation of Our Invention

In one embodiment of our invention, rail 100 is inserted between centering guide rollers 96, chain 78 and cam rollers 44. The lever arms 46 and offset center blocks 48 are then adjusted and springs 90 attached to brackets 92 in order to clamp cam rollers 44 against rail 100. Then the motor may be engaged to turn drive sprocket 76 with sufficient force to motivate drive along path of rail 100. As drive sprocket 76 is turned, chain 78 transfers the torque into linear motion, distributing the dynamic force among multiple rollers 79 and notches 103. When rotation of drive sprocket 76 is halted, the resulting static load continues to be carried by chain 78 and distributed among multiple rollers 79 and notches 103.

Typical mill tolerances allow some degree of inconsistency in the thickness of standard structural shapes. To account for the fluctuations in thickness, our invention is equipped with rail tolerance adapting cam roller plates 42 which hold cam rollers 44 securely against rail 100 at all times. Tension spring 90 pulls against lever arms 46, exerting a constant torque against offset center block 48. Because the center of the holes in roller plates 42 are eccentric with respect to shafts 66, cam rollers 44 are squeezed against rail 100. The mechanical advantage of this eccentric arrangement is compounded by lever arms 46 and for a total leverage ratio of 36:1 combining with spring rate of springs 90 to apply over 4,000 lbs of clamping force to rail 100.

Pivot point drive attachment hitches 80 are then fastened to mating carriage components for the purpose of lifting equipment or personnel, as shown in FIG. 5. In the case of an electrically driven system, control box 122 houses a motor/brake controller which the operator 116 uses to execute variable speed movement and braking. If the rail 100 is attached to an arch (see FIG. 16) then the drives 38 will pivot about their hitches 80, remaining individually tangent to the rails' varying slope. Lift basket 114 remains level regardless of rail slope because its pivot point 115 is situated along the center of gravity of basket 114.

Some structures have only a slightly variable slope or none at all, so for these structures our invention can be constructed as shown in FIG. 6. Basket 114 is not attached to a center of gravity pivot point. Drive 38 and guide wheel assembly 124 are pivoted, however, to prevent undue stress and possible jamming where slight variations in rail slope may occur. If a manually actuated brake is provided in addition to the typical motor/brake combination and attached to drive sprocket 76, then in the event of power outage or motor failure our system can execute a safe manual descent.

During erection of structures a combination personnel and equipment lift embodiment of our invention may be used as shown in FIG. 7. In some cases entire structures could be built with our system, eliminating the need for a crane or winch. FIG. 8 explores this concept further, illustrating an articulated boom 130 mounted atop truss 132 and motivated by drives 38. In this strategy, large sub assemblies 128 are put together on the ground then driven up the tower 126, which has a temporary rail 100 mated to its legs. Using either of these methods a structure can literally build itself since no additional structural equipment is required.

Rigid portable towers can be manufactured using our innovation. FIG. 9 illustrates a truck 142 and trailer 144 arrangement which carries pre-assembled tower components 128 and an extrusion assembly 146. The truck can drop the trailer on a job site and the system made ready for tower erection in a matter of minutes. FIG. 10 shows outriggers 136, guy wires 140, and extrusion assembly 140 in their ready positions. FIG. 11 shows one tower component 128 inserted into extrusion assembly 146 and mated with drives 38. Now the tower component 128 can be driven vertically, making room for another below it (FIG. 12). If the tower is to be tall enough that it requires additional guy wires then one or multiple stabilizing guy wire drive assemblies 141 may be attached around the extruded tower components 128 (FIG. 13). This drive assembly 141 is fitted with the appropriate anchored guy wires 140, which are pre-tensioned to the required load. When extrusion assembly 146 is activated to drive the tower up another segment, assembly 141 is synchronized with extrusion assembly 146. Both drive assemblies 141 and 146 extrude the tower at the same rate, thereby retaining guy wire 140 tension.

There are numerous creative products which our invention now makes it possible to explore at reasonable cost. Telescoping tower components can make use of our drives 38 as illustrated in FIG. 14. Large boom cranes can benefit from the use of our drives and extrusion assemblies. And massive articulated tripod booms 155 (FIG. 15) can be constructed. Entire structures can be erected in the stone manner, and once the components are joined the bases can be fastened to typical foundations and our extrusion assemblies removed. Even complex variable geometry structures, like the arch of FIG. 16 and the bridge segments of FIG. 17 & 18, can be erected using applications of our invention.

Summary, Ramifications, and Scope

Thus the reader will sec thin our innovation not only goes beyond existing lift and erection technology but, in fact, redefines it. The safety and longevity features of our drives multiple roller/notch engagement actually reduce the cost of our system as compared to others that are gear driven. Common mechanical and simple machined pans are used to construct our innovation, making it easier and less expensive to manufacture and maintain. And our system can withstand terrible abuse in harsh environments under heavy loads and high duty cycles.

Although the above descriptions have spelled out a few specific embodiments, tile scope of our invention should not be limited to this smattering of illustrations. As an example, the rail tolerance adapting mechanism can be outmoded by simply eliminating the cam roller plates and offset center block assemblies, allowing the pressure plate assembly to do the task by itself. Or rail tolerancing could be dropped altogether and allowances made elsewhere in the design.

Therefore the scope of our invention should not be determined by the examples given, but by the appended claims and their legal equivalents.

We claim:

1. An apparatus for moving an elevator up and down a structure, comprising in combination:

a drive rail adapted to be mounted to the structure, the drive rail having an engagement bar with an edge containing a plurality of notches, the drive rail having a flange extending laterally from the engagement bar, the flange having at least one track on a side opposite the notches;

a frame adapted to be mounted to an elevator;

two outboard sprockets and at least one inboard sprocket mounted to the frame, one of the sprockets adapted to be driven by a power source;

an endless chain extending in a loop around the sprockets, providing an engagement run between the outboard sprockets for meshing engagement with the notches of the engagement bar;

a pressure plate carried by the frame in the loop of the chain in sliding engagement with the engagement run to maintain the engagement run in meshing engagement with the notches; and a plurality of support rollers carried by the frame in rolling engagement with the track as the power source rotates the chain, causing the frame and the elevator to move along the rail.

2. The apparatus according to claim 1, further comprising:

biasing means for urging the support rollers into contact with the track.

3. The apparatus according to claim 1, further comprising:

shock absorbing means for absorbing shock applied to the pressure plate as the frame moves along the rail.

4. The apparatus according to claim 1, wherein the pressure plate extends substantially the entire distance between adjacent edges of the outboard sprockets.

5. The apparatus according to claim 1, wherein:

the chain comprises a plurality of links, each link having a chain roller between a pair of link plates; and wherein the pressure plate locates between the link plates and slidingly engages the chain rollers.

6. The apparatus according to claim 1, further comprising:

a pressure plate mounting block secured to the frame; and an elastomeric layer secured to the mounting block; and wherein the pressure plate is mounted to the elastomeric layer, which absorbs shock as the frame moves along the rail.

7. The apparatus according to claim 1, wherein the support rollers are pivotally mounted to the frame.

8. In an elevator having a cage, an improved apparatus mounted to the cage for moving the cage up and down a structure, comprising in combination:

a drive rail mounted to the structure, the drive rail having an engagement bar with an edge containing a plurality of notches, and having a flange extending laterally from each side of the engagement bar, the flange having a pair of tracks;

a frame mounted to the cage;

two outboard sprockets and at least one inboard sprocket rotatably mounted to the frame, one of the sprockets being driven by a power source;

an endless chain having a plurality of links, each link having a central chain roller section rotatably carried between two central link plates and two lateral chain roller sections on each side bounded by lateral link plates, the chain extending in a loop around the sprockets, defining an engagement run between the outboard sprockets with the central roller sections engaging the notches of the engagement bar;

a pair of pressure plates;

pressure plate mounting means for mounting the pressure plates to the frame in the loop of the chain in engagement with the lateral roller sections of the engagement run to maintain the engagement run in meshing engagement with the notches;

at least one roller plate pivotally carried each side of the frame;

a plurality of support rollers mounted to each roller plate; and spring means connected between the roller plates and the frame for urging the support rollers in engagement with the tracks to hold the engagement run in engagement with the notches as the power source rotates the chain to move the frame and the cage along the rail.

9. The elevator according to claim 8, wherein the spring means comprises:

at least two eccentric lever arms, each mounted to one side of the frame, each of the roller plates being pivotally mounted to one of the lever arms; and a coil spring extending between each of the lever arms and the frame.

10. The apparatus according to claim 8, wherein the pressure plate mounting means includes shock absorbing means for absorbing shock applied to the pressure plates as the frame moves along the rail.

11. The apparatus according to claim 8, wherein the pressure plates extend substantially the entire distance between adjacent edges of the inboard sprockets.

12. The apparatus according to claim 8, wherein the pressure plate mounting means comprises:

a pressure plate mounting block secured to the frame; and an elastomeric layer secured to the mounting block; and, wherein the pressure plates are mounted to the elastomeric layer, which absorbs shock as the frame moves along the rail.

13. The apparatus according to claim 8, wherein:

each of the sprockets has a central sprocket member and two lateral sprocket members, the lateral sprocket members engaging the lateral roller sections, the central sprocket members engaging the central roller section; and the central sprocket section of each of the sprockets has a lesser diameter than the lateral sprocket sections.

14. The apparatus according to claim 8, wherein there are two of the roller plates pivotally mounted on each side of the frame, each having a plurality of the support rollers.

15. In an elevator having a cage, an improved apparatus mounted to the cage for moving the cage up and down a structure, comprising in combination:

a drive rail mounted to the structure, the drive rail having an engagement bar with an edge containing a plurality of notches, and having a flange extending laterally from each side of the engagement bar, the flange having a pair of tracks on a side opposite from the notches;

at least one drive assembly, comprising:

a frame mounted to the cage and having two parallel sides;

two outboard sprockets and at least one inboard sprocket rotatably mounted between the sides of the frame in a triangular configuration, one of the sprockets being driven by a power source;

an endless chain having a plurality of links, each link having a chain roller rotatably carried between two link plates, the chain extending in a loop around the sprockets, defining an engagement run between the outboard sprockets with the chain rollers engaging the notches of the engagement bar;

a pressure plate mounting block mounted between the sides of the frame within the loop;

an elastomeric layer mounted to the mounting block;

a pressure plate mounted to the elastomeric layer and in engagement with the chain rollers of the engagement run;

at least one roller plate pivotally carried on each side of the frame;

a plurality of support rollers mounted to each roller plate; and spring means connected between the roller plates and the frame for urging the support rollers into rolling contact with the tracks to hold the engagement run in engagement with the notches.

16. The elevator according to claim 15, wherein the spring means comprises:

at least two eccentric lever arms, each mounted to one side of the frame, each of the roller plates being pivotally mounted to one of the lever arms; and a coil spring extending between each of the lever arms and the frame.

17. The apparatus according to claim 15, wherein there are two of the roller plates pivotally mounted on each side of the frame, each having a plurality of the support rollers.

18. The apparatus according to claim 15, wherein the pressure plate extends substantially the full distance between adjacent edges of the outboard sprockets.

19. The apparatus according to claim 15, wherein there are two of the drive systems, each engaging the same drive rail.

* * * * *